US006397754B1

(12) United States Patent
Perlid

(10) Patent No.: US 6,397,754 B1
(45) Date of Patent: Jun. 4, 2002

(54) METHOD AND APPARATUS FOR CHARGING BOREHOLES WITH EXPLOSIVES

(75) Inventor: Hans Perlid, Dylta Bruk (SE)

(73) Assignee: Nitro Nobel AB, Nora (SE)

( * ) Notice: Subject to any disclaimer, the term of this patent is extended or adjusted under 35 U.S.C. 154(b) by 0 days.

(21) Appl. No.: 09/424,016

(22) PCT Filed: May 12, 1998

(86) PCT No.: PCT/SE98/00866

§ 371 (c)(1),
(2), (4) Date: Nov. 18, 1999

(87) PCT Pub. No.: WO98/55805

PCT Pub. Date: Dec. 10, 1998

(30) Foreign Application Priority Data

Jun. 5, 1997 (SE) ..... 9702151

(51) Int. Cl.[7] ..... F42B 3/00; F42C 19/12
(52) U.S. Cl. ..... 102/312; 102/313; 86/20.15
(58) Field of Search ..... 86/20.15; 102/312, 102/313

(56) References Cited

U.S. PATENT DOCUMENTS

| | | | | |
|---|---|---|---|---|
| 4,995,925 A | | 2/1991 | Engsbråten | 149/2 |
| 5,007,345 A | * | 4/1991 | O'Garr | 102/313 |
| 5,105,743 A | | 4/1992 | Tano et al. | 102/313 |
| 5,233,926 A | * | 8/1993 | Carmichael et al. | 102/313 X |
| 5,584,222 A | * | 12/1996 | Engsbraten et al. | 86/20.15 |
| 5,841,055 A | * | 11/1998 | Hooper et al. | 86/20.15 |
| 6,070,511 A | * | 6/2000 | Palmer et al. | 86/20.15 |

FOREIGN PATENT DOCUMENTS

| | | |
|---|---|---|
| GB | 1202478 | 8/1970 |
| GB | 1261486 | 1/1972 |
| WO | WO90/13788 | 11/1990 |
| WO | WO94/00667 | 1/1994 |
| WO | WO94/04885 | 3/1994 |
| WO | WO96/29567 | 9/1996 |

* cited by examiner

*Primary Examiner*—Peter A. Nelson
(74) *Attorney, Agent, or Firm*—Burns, Doane, Swecker & Mathis LLP

(57) ABSTRACT

A method and a device for charging boreholes (11) with explosives. One end of the charging hose (3) is introduced to a substantially predetermined distance from the bottom of the borehole. Subsequently, a pumpable explosive is pumped through the charging hose at a controlled rate and substantially simultaneously with the pumping of the explosive the charging hose is withdrawn from the borehole at a controlled rate. The explosive is caused to flow out from a nozzle (13), arranged on said end of the charging hose (3), in the form of a hollow cone (18) and at high pressure, so that the outflowing explosive is given increased viscosity and by virtue of the high outflow rate cohesively adheres to the entire cylinder-shaped wall portion (19) of the borehole (11), upon which the explosive impinges in connection with said outflowing. With the aid of a centering device (14), the nozzle (13) is centered in the borehole (11).

17 Claims, 2 Drawing Sheets

METHOD AND APPARATUS FOR CHARGING BOREHOLES WITH EXPLOSIVES

Figure 1:
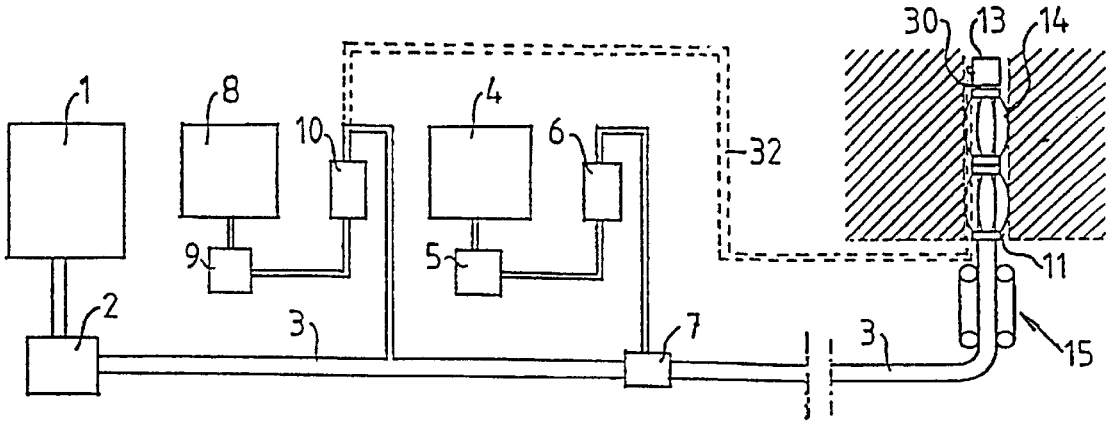

The present invention relates to a method for charging boreholes with explosives, comprising the steps of introducing one end of a charging hose into the borehole to a substantially predetermined distance from the bottom of the borehole, pumping a pumpable explosive through the charging hose at a controlled rate and, essentially simultaneously with the pumping of the explosive, withdrawing the charging hose from the borehole at a controlled rate.

The invention also relates to an apparatus for charging boreholes with explosives, comprising a vessel containing a pumpable explosive, a charging hose adapted for insertion into a borehole, pumping means connecting the vessel with the charging hose for transporting the explosive to the borehole and hose operating means for achieving the movement of the charging hose in the borehole at a controlled rate.

Specifically, the invention relates to a method and an apparatus for charging pumpable explosives in a reduced amount in relation to the amount corresponding to the complete fill-up of a borehole.

In connection with blasting, it is often suitable to reduce the charge compared to that which corresponds to completely filling up the borehole. One may wish to achieve a smooth and strong final contour, to reduce vibration in connection with blasting or to follow ore faces and reduce undesired waste rock removal. In driving tunnels or galleries, cautious blasting of the contour holes may give a substantially undamaged rock face with significantly reduced needs for subsequent repair and support work, such as bolting, guniting, concrete reinforcement, etc., and the final profile will be more true to the design size. Similar considerations arise in underground mining and stoping or in attempts to limit the production of fines to meet certain after-processing requirements. Although numerous closely spaced boreholes can be used to produce smooth fracture planes, the method is limited by practical and economical constraints.

One approach could be to use smaller borehole diameters in contour or other holes where reduced explosive power is desirable. This is impractical and would increase the cost of blasting as well as render it more difficult. Instead, the trend is towards wider boreholes, which further increases the need for reduced charges.

A second method is to dilute the explosives with lightweight materials which reduce the density of the charge. U.S. Pat. No. 4,995,925 describes this method in more detail. However, the product has low water resistance and must be used in combination with other explosives.

Common problems associated with the above-mentioned charging methods are inconsistency in charging and uncontrolled coupling between explosive and rock. Detonation failures have also occurred in certain explosives, probably because of precompression from forerunning shock waves in the free gas channel.

A third method, disclosed in U.S. Pat. No. 5,584,222, is to use a string of pumpable or blowable explosive. In the case of a pumpable explosive, the string is obtained by adjusting the withdrawal rate of the charging hose in relation to the product flow rate, i.e. to the speed of the pump. However, the method of using pulverulent or liquid strings is adapted to horizontal or somewhat inclined boreholes.

U.S. Pat. No. 5,105,743 describes a method in which a standard blowable explosive is utilised in partially filling a borehole. The method is limited to particulate and blowable explosives and is of limited use in, for example, wet environments or other situations where pumpable explosives are needed. The method requires different tools for different borehole diameters and tends to result in uneven amounts along the length of the hole.

The object of the present invention is to provide a method and an apparatus for charging boreholes with explosives suitable for all borehole directions, but especially for up-holes.

A further object of the invention is to provide a method and an apparatus allowing filling of only a desired part of the cross-sectional area of the borehole with a pumpable explosive and allowing the explosive to be distributed as uniformly as possible around the entire borehole wall.

Yet another object of the invention is to provide, if applicable, draining of the charged borehole of penetrating ground water.

It is also an object of the invention to obviate the risk of water pockets forming between the explosive and the borehole wall, when water is used as a lubricant in the charging hose.

These objects are achieved according to the invention by a method according to the introductory paragraph, characterised by causing the explosive to flow out in the form of a hollow cone and at high pressure from a nozzle arranged on said end of the charging hose, so that the outflowing explosive is given increased viscosity and consequently adheres in a cohesive manner to the entire cylinder-shaped wall portion of the borehole, upon which the explosive impinges in connection with said outflowing.

An apparatus for carrying out the above-described method is characterised in that the apparatus, in addition to the components mentioned by way of introduction, also comprises a nozzle, from which the explosive is caused to flow out in the form of a hollow cone and at high pressure, that the nozzle is fastened to the end of the charging hose by means of a fastening member, and that at least one centring device is arranged on the charging hose, which centring device comprises a pair of separate, annular members intended to engage with the outside of the charging hose, as well as a plurality of arcuate, resilient members of considerable length in relation to their width and thickness, which latter members are oriented essentially in the longitudinal direction of the charging hose and connected to the annular members as well as adapted under compressive stress resiliently to abut against the cylinder-shaped wall of the borehole.

Further developments of the invention will appear from the features recited in the subclaims.

The method according to the invention has no limitations with respect to the direction of the borehole, and can thus be applied in vertically upwardly directed holes, in vertically downwardly directed holes, in horizontal holes, or in holes of any borehole direction. Nevertheless, the method is particularly advantageous for upwardly directed charging, and particularly if the upwardly directed charging is combined with chemical gassing. By adjusting the degree of charging/amount of explosive to the specific need in each borehole, the range of explosives can be limited to a pumpable emulsion explosive and a primer, and a detonator for initiation. Moreover, the invention is of great practical importance in all types of charging, where the product is sensitised by means of chemical gassing during and after charging.

The method for achieving partial charging of the borehole consists of pressing emulsion explosive under high pressure through a special nozzle in the hose end. For the best results, the nozzle is centred in the borehole. This is effected by providing the outermost part of the hose with a special centring device, preferably comprising fastened, resilient lamellae.

The nozzle sprays the explosive in the form of a hollow cone onto the borehole walls, providing very good anchoring to the borehole surface. The desired charging degree according to the invention is subsequently achieved in the known manner by adjusting the withdrawal of the hose to the flow rate of the explosive, i.e. the pumping and withdrawal rates. The explosive is applied as a cylinder or in the form of a tube to the borehole wall, while the bottom and the innermost portion of the borehole, where the igniting means, i.e. the primer and the detonator, are arranged, are also completely filled with explosive.

By forming a tube of pumpable explosive, only partially filling up a borehole diameter, several objectives are achieved. The explosive itself need not be highly diluted, with corresponding problems; rather energy reduction is accomplished by quantity and by the wall thickness of the explosive tube. Variability in specific loading is obtained and specifically it is possible also to charge some boreholes in their entirety thereby utilising the full power of an explosive. Yet the most pronounced advantages are obtained in cautious blasting with tubes of small wall thickness of the explosive. It has been found that a tubular pumpable explosive behaves neither as confined nor as unconfined, with high detonation velocities. Rather it detonates with markedly reduced velocity and shock generation, perfectly meeting the requirements of cautious blasting. The charging method outlined and the detonation mechanism obtained sustains a stable and undisturbed detonation even in thin tubes, contrary to previous experience. The method is compatible with both microsphere sensitised and gassed explosives. The latter explosive type may optionally benefit from foaming into the free radical space without axial movements. The method requires no auxiliary devices in addition to the explosive itself. The apparatus according to the side claim forms the constructional basis for the critical parts of the charging method, supporting the above-mentioned advantages.

Although most explosives have a gap sensitivity sufficient to bridge and maintain reaction over certain interruptions in the tube, it is preferred that the formed tube is substantially cohesive over the relevant length without any large thinnings or discontinuities. Small irregularities are of no significance and may to some extent be unavoidable because of roughness of the borehole walls or other disturbances. The principles of the invention may be used for charging the entire or only part of the borehole length. Generally, it is preferred that the major part of the borehole length is charged with a tube according to the invention.

The tube may have a systematically varying wall thickness over the length of the borehole. A preferred kind of variation is to have a decreasing thickness from the inner part of the borehole towards the hole opening in order to meet the requirements for higher amounts in the innermost part of the hole. In most applications, though, it is preferred to have an essentially constant wall thickness.

The method steps are adapted to give an explosive tube with the above-mentioned characteristics. The borehole is charged from the bottom or innermost part by pumping the explosive at a controlled rate from a charging hose under simultaneous withdrawal of the hose at a controlled rate. By mutually adjusting the pumping and withdrawal rates, the desired amounts of explosive can be extruded from the hose end. Both rates can vary over time to give either a varying or a constant exiting amount of explosive although it is preferred to keep at least one of the rates constant. When spraying a tube of varying wall thickness, it is preferred to keep the withdrawal rate constant and when spraying a tube of constant wall thickness to keep both rates constant.

According to the invention, part of the borehole may be charged differently than with the explosive tube. Specifically, igniting means in the form of detonators and/or primers are positioned in the borehole, usually in the innermost part. In order to secure a safe ignition, it is suitable to use an excess of explosive around the igniting means and preferably entirely fill up the borehole diameter around it. Similarly, the outermost borehole parts may need less or no amounts of explosive. Excess charging can be obtained by a delay in hose withdrawal in relation to pump start and a reduction by slowing or stopping pumping.

Partial charging is highly independent of absolute borehole diameter and the charging of explosives according to the invention may be utilised for broad size ranges. Partial charging is expressed herein as the cross-sectional area of the exiting tube in relation to the cross-sectional area of the borehole. In broad terms, the charging degree thus expressed may lie between 20 and 100 percent and preferably between 40 and 90 percent.

The exact degree of partial charging depends on the purpose of the reduction. Too high degrees may give insufficient reduction and too low degrees insufficient breakage.

As indicated, in partial charging according to the invention, it is possible, and in cautious blasting desirable, to strive for velocity of detonation (VOD) significantly lower than the velocity obtained both fully confined and fully unconfined. When utilising this possibility, the VOD may be between 25 and 100 percent, and preferably between 30 and 80 percent of VOD for the same explosive, in the same tube size, detonated freely on the ground. It may be that the wall thickness of the tube is too thin to detonate freely and in that case the above-mentioned values should be compared with the smallest tube freely detonatable. In absolute terms, VOD may be between 1000 and 6000 m/sec.

Another application for the partial charging according to the invention is to adapt the charge strength to the specific need in each borehole, i.e. even stoping holes and production holes, not just contour holes. For this purpose a broader range of partial charging degrees can be used and in particular the higher charging degrees, such as 50 to 95 percent, and preferably 80 to 95 percent.

According to the invention, at least one borehole is partially charged with an explosive tube for any of the above purposes. In order to take advantage of the flexibility of the invention, it is preferred that several boreholes are charged with different charge ratios, in particular several boreholes which are to be blasted in the same round. It is within the scope of the invention that any one of such additional boreholes is fully charged, i.e. to substantially 100 percent as above, in order to utilise the full scope of the invention.

An apparatus for carrying out the method according to the invention and for charging of explosives in a controlled volume amount per borehole length unit comprises a vessel for the explosive and a charging hose for insertion into the borehole as well as a conduit connecting these devices. A nozzle is attached to the free end of the charging hose and is centred in the borehole with the aid of one or two successively arranged centring devices on the charging hose, closely adjacent to its free end.

The conduit comprises a pump capable of feeding the pumpable explosive at a controlled and stable volume rate, which rate should preferably be variable in order to allow different degrees of partial charging. Positive displacement pumps giving small flow rate variations, such as eccentric screw pumps, may be used.

If the explosive is to be chemically gassed, the conduit may include an inlet for the gassing agent, normally a liquid, a vessel for such an agent, and a pump for transporting and dosing the agent in the conduit.

In order to reduce the pressure requirement in pumping the explosive, it is suitable to arrange for the introduction of a lubricating fluid between the hose interior surface and the explosive. The fluid may be water but is preferably an aqueous solution of oxidising salt similar to those present in the explosive itself. The arrangement may comprise an inlet for the lubricating fluid ending in an annular chamber surrounding the channel of the conduit and having an annular opening towards the channel for forming a liquid ring around the centrally fed explosive.

The apparatus includes means for moving the hose. These means should at least permit forward movement of the hose when being inserted into the borehole and driving means for withdrawing the hose at a controlled rate. The rate may vary during the charging operation, but is preferably constant. Suitably, the driving means also assist in the forward motion of the hose.

Any type of moving means meeting these requirements can be used for the purposes of the invention. One type of such moving means comprises opposed wheels or belts, gripping a part of the hose therebetween and driving means connected to at least one of the opposed wheels or belts capable of moving the hose at least in the withdrawal direction. A preferred device of this kind is described in the Swedish patent 8903101-7 (465 566). The device is highly flexible and allows strongly variable feeding speeds both in the forward and in the reverse direction.

Another preferred type of hose moving means comprises a winder or reel with guiding means for receiving turns of the charging hose on its peripheral part, preferably in a monolayer, and driving means for rotating the winder in a direction withdrawing the hose from the borehole towards the winder at a controlled rate. This device may include disengaging means allowing manual unwinding of the hose during the rotation of the winder. The guiding means may comprise restricting means for preventing radial expansion of hose turns on the winder, except at a point of unwinding, whereby the hose is held securely in place on the winder and pushing action is also made possible.

The apparatus should also comprise adjusting means for setting the ratio between the controlled pumping rate and the controlled hose withdrawal rate in order to expel the explosive in the volume rate desired to give said explosive tube characteristics. The adjusting means may include means for varying the pumping rate and/or the withdrawal rate. A simple, yet for many purposes sufficient, arrangement is to use adjusting means giving a constant withdrawal rate and a variable pumping rate. Hydraulic motors are preferred driving means for pump and withdrawal means, permitting a wide range of stable rates.

In addition to allowing partial filling of boreholes, the invention has a number of other aspects which are of great significance to the invention and to its practical use.

By pressing the explosive under high pressure through a narrow nozzle opening, strong turbulence and processing of the emulsion are achieved. This results in increased viscosity of the emulsion, which is desirable, if not to say necessary for upwardly directed holes, and enables the emulsion to remain against the borehole wall by friction as well as enabling cohesion within the high viscosity emulsion. The fact that increased viscosity can be achieved by pressing an emulsion of the type in question through a narrow slot is known per se, but to effect this by means of a nozzle in the end of the charging hose in upwardly directed charging is a novelty.

In some boreholes, water and water pressure are a problem. In some upwardly directed holes or horizontal holes, water pressure can press the emulsion out of the boreholes if the holes are fully charged. With a partially filled borehole, as described herein, a channel is created in the explosive allowing draining of the borehole.

Another aspect concerns the water used for lubricating the inside of the hose according to U.S. Pat. No. 5,584,222. According to this patent, an annular nozzle is used for adding a few percent water (calculated in terms of the emulsion flow) at the start of the charging hose. In this way, a film forms on the inside of the hose, allowing the emulsion to flow more or less like a rod through the hose. This makes it possible to reduce the charging pressure significantly. The technique of using an "aqueous ring" in this manner, is now common practice in emulsion charging, at least if the hose length exceeds 10–20 m and the charging hose diameter is about 1.5" or less. However, in upwardly directed charging the water creates problems since it may also lubricate the borehole wall and result in the explosive not remaining where it has been applied but sliding downwards. Water pockets may also form. In this context, another important effect of the turbulence and mixing taking place in the nozzle can be seen: the fact that the water or the aqueous solution is mixed into the emulsion and becomes an integral part of the same.

Another function of the nozzle is to act as a mixer for desensitised emulsion and gassing solution when the emulsion is sensitised by means of chemical gassing. In this way, the transition from a matrix to an explosive takes place in the borehole itself, which is extremely advantageous from a safety point of view. The gassing is effected by means of a chemical reaction between the ammonium ions in the emulsion and the nitrite ions in a gassing solution which is added in a separate conduit, or alternatively as the whole or as a part of the above-mentioned aqueous ring:

$$NH_2^+ + NO_2^- \Rightarrow N_2 + 2\ H_2O$$

The evolved nitrogen is present as fine blowholes in the emulsion and constitutes centres of reaction when the explosive is initiated and a shock wave propagates through the explosive.

The evolution of nitrogen results in a volume expansion of the explosive which, depending on the dosage, usually amounts to 15 to 50% of the original volume of emulsion and gassing agent. In connection with this increase of volume we can observe another important effect of not completely filling the borehole but rather leaving room for the increase in volume. In this way, the expansion can take place radially. This is easier to carry out and results in smaller losses of gas and lower pressure than in the case of axial expansion, which occurs in conventional charging when the entire hole is filled.

In all of the above-mentioned aspects of the invention, the nozzle is of major importance. The centring equipment has been developed in order to enable the nozzle to distribute the emulsion uniformly around the entire cross-sectional area.

In addition to the mixing function, the cone angle is of major importance. The cone angle shall achieve a balanced distribution of a radial velocity component, providing the required adherence to the borehole wall, and an axial velocity component, ensuring that the emulsion ends up at a sufficient distance from the front of the hose. In this way, contact between the outside of the hose and the charged emulsion is minimised.

Moreover, it is within the scope of the invention to adjust the charging degree or the size of the tube (the wall thickness of the formed explosive tube) in the same borehole to the most suitable level. In practice this means that, for example, the primer and detonator are positioned at the bottom of the borehole. In order for the primer to become attached it is suitably provided with a locking device in the form of a retaining spring. Subsequently, the charging is effected by withdrawing the charging hose a suitable distance, e.g. 20–80 cm depending on the hole diameter and the pump capacity. In this position, the charging with emulsion explosive begins, initially without withdrawing the hose. When the volume around and a few centimeters behind the primer has been filled, but still at a safe distance from the nozzle, the withdrawal of the hose is initiated. This effect is achieved by means of a timed delay.

The rest of the borehole is then charged by withdrawing the hose while simultaneously spraying emulsion. As stated above, the linear rate at which the hose is withdrawn in relation to the flow rate of the emulsion determines the thickness of the ring or the tube in the cross-sectional area of the hole. By changing the flow rate or the rate at which the hose is withdrawn the size of the ring can be adapted as required, e.g. the amount of explosive per length unit can be reduced in the outer part of the borehole. However, as a rule, subsequent to charging the bottom, the same charging degree is utilised in the rest of the hole.

Naturally, it is within the scope of the invention to utilise the present method and apparatus in a single hole in a round or—which is the most practical—in every hole in a round. In each round, the charging degree can then vary according the requirements of different boreholes, for example the charging degree is reduced in the boreholes closest to the contour. Many of the holes are production holes and are normally fully charged. This puts high demands on flow rate control in relation to withdrawal if one wishes to avoid air pockets or soiling the hose. An easier way of handling these problems is to apply the invention also to the "fully charged holes" by filling them to about 95%.

Figure 2:
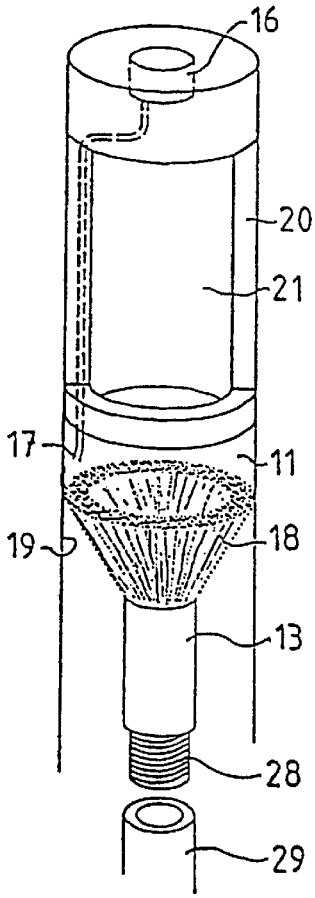
Figure 3:
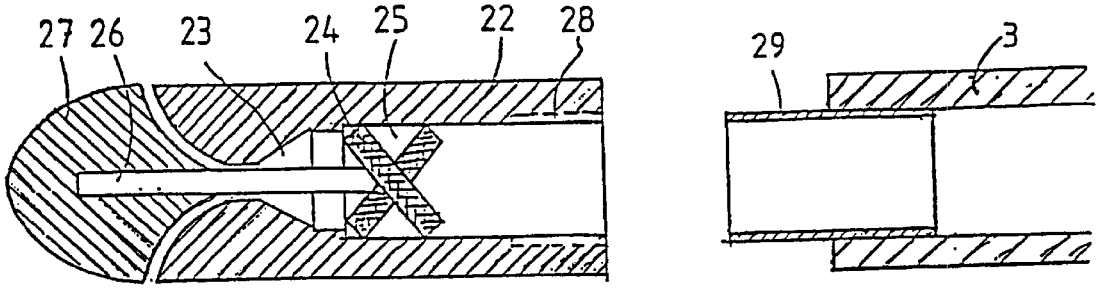
Figure 4:
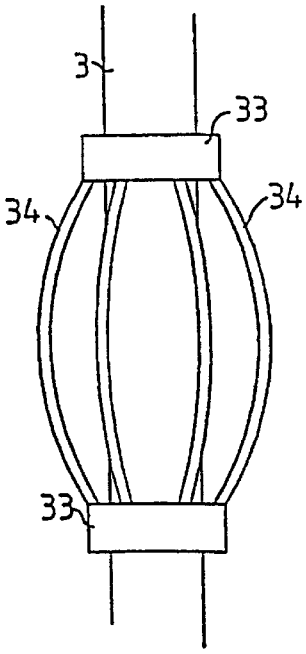

A preferred embodiment of the apparatus according to the invention will now be described by way of example with reference to the accompanying drawings, in which:

FIG. 1 schematically shows the component parts of the apparatus according to the invention;

FIG. 2 is a schematic, part-sectional perspective view of the nozzle during charging of a borehole with explosive;

FIG. 3 schematically shows the nozzle, its fastening member, and the free end of the charging hose, prior to assembly and in axial section;

FIG. 4 shows the centring device according to the invention; and

Figure 5:
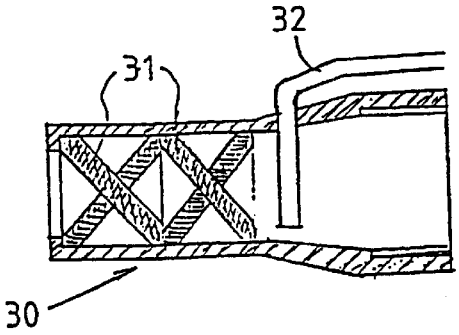

FIG. 5 schematically shows an inlet member which in a modified embodiment is intended to be attached between the charging hose and the nozzle.

With reference first to FIG. 1, the apparatus for charging boreholes with an explosive according to the invention comprises a vessel 1 containing a pumpable explosive or matrix, a pump 2, and a charging hose 3, which is connected to the vessel 1 by the intermediary of the pump 2. The operation of the pump is adjustable, whereby the flow rate of the explosive can be controlled. A vessel 4 for lubricant (e.g. water) is preferably connected to the charging hose 3 by the intermediary of a pump 5, a flowmeter 6, and an insertion device 7 for lubricant. If desired, a vessel 8 containing a gassing agent may also be connected to the charging hose 3 by the intermediary of a pump 9 and a flowmeter 10 between the pump 2 and the lubricant vessel 4. The gassing agent may also be introduced at the end of the charging hose 3 just before the nozzle 13. The gassing agent is either supplied through a separate gassing agent hose 32 running outside the charging hose 3, as indicated by dashed lines in FIG. 1, or the gassing hose is integrated with the charging hose, as indicated by solid lines in the Figure.

FIG. 1 also shows the free end of the charging hose 3 introduced into a borehole 11 in the rock 12 and with a nozzle 13 attached to said hose end. A pair of centring devices 14 are arranged on the charging hose adjacent to its free end. With the aid of a hose operating means 15, the charging hose 3, and thus the nozzle 13, are moved at an adjustable rate in the borehole 11. By adjusting the capacity of the pump and/or the movement of the hose the outflow of explosive is controlled at every point along the length of the borehole 11.

Reference is now made to FIG. 2, which is a more detailed illustration of the charging of a borehole with explosives. When the primer and the detonator/igniter, generally designated 16, have been attached to the bottom or innermost portion of the borehole 11, preferably with a locking device in the form of a retaining spring, and the igniter cord or hose 17 has been connected to the igniting means 16, the charging is carried out by withdrawing the charging hose 3 a suitable distance from the bottom of the borehole. In this position, the charging with emulsion explosive begins, initially without withdrawing the hose. When the volume around and a few centimeters behind the primer has been filled, but still has not reached the nozzle, the withdrawal of the hose begins. This effect is achieved by means of a timed delay. The nozzle 13 sprays the explosive in the form of a hollow cone 18 towards the cylinder-shaped wall 19 of the borehole 11, the explosive being deposited as a ring in the borehole. Subsequently, the rest of the borehole is charged by withdrawing the hose during simultaneous spraying of emulsion explosive, a hollow cylinder or a tube 20 forming on the wall 19. As stated above, the rate at which the hose is withdrawn in relation to the flow rate of the emulsion determines the share of the cylinder's cross-sectional area in the cross-sectional area of the hole. By changing the flow rate or the rate at which the hose is withdrawn, the size of the cross-sectional area of the cylinder can be adapted as required, e.g. the amount of explosive per length unit can be reduced in the outer part of the borehole. However, as a rule, subsequent to charging the bottom, the same charging degree is utilised in the rest of the hole. In the thus partially filled borehole a channel 21 is created in the explosive, allowing draining of the borehole 11 or permitting radial expansion in connection with chemical gassing.

FIG. 3 is a sectional exploded view which schematically illustrates the nozzle and a way of attaching it to the free end of the charging hose. The nozzle 13 consists of a substantially cylindrical body 22 with an angled, cone-shaped outlet 23, a swirl chamber 25 with turbulence or mixing members 24 in the central part of the nozzle, a rod 26 connecting the body 22 of the nozzle to an adjustable head 27, as well as a threaded portion 28 at the other end of the nozzle for connecting to the free end of the charging hose 3. The nozzle is utilised both for efficiently mixing in the lubricating water/water ring used as a lubricant in the charging hose, and for achieving the spray pattern in the form of a hollow cone. This is achieved by means of a tangential inflow in the swirl chamber. Different angled outlets and different swirl chamber members give different dispersion angles (about 30°–120°) for different charging applications. The nozzle can also be used with no head 27 or rod 26. Other nozzle designs can also be used.

In the embodiment shown in FIG. 3, the threaded portion 28 of the nozzle consists of an internal thread for engagement with a fastening member 29 in the form of an exteriorly threaded fastening tube, which in an optional, known manner is fixed to the lumen of the charging hose.

The threaded portion 28 may also consist of an exterior thread, as shown in the embodiment according to FIG. 2. In that case, the fasting member 29 is suitably an internally threaded sleeve attached to the lumen of the charging hose by means of an integrated or separate nipple member (not shown) in a manner known per se.

An inlet member 30 for a gassing agent can be arranged between the threaded portion 28 and the fastening member 29, cf. FIG. 1, with or without mixing members 31 and with or without a gassing agent admission opening 32 depending upon where in the system the gassing agent is added.

The charging apparatus according to the invention also comprises at least one, and preferably two, centring device 14 in the area of the free end of the charging hose 3. The centring device 14 is concentrically arranged around the charging hose and comprises a pair of separate, annular members 33, which are in engagement with the outside of the charging hose. A plurality of arcuate, resilient and elongate members 34, oriented substantially in the longitudinal direction of the charging hose 3, are equidistantly arranged around the charging hose and are attached to the annular members 33. Furthermore, the length of the elongate members 34 is considerable in relation to the width of the annular members 33, as can be seen in FIG. 4. The elongate members 34 are preferably lamella-shaped and form the body of an imaginary solid of rotation in the form of a sphere, an ellipsoid or the like, whose largest diameter transversely of the longitudinal direction of the charging hose exceeds the diameter of the borehole 11. In this way, the lamellae are caused to abut under compressive stress against the cylinder-shaped wall 19 of the borehole, when the charging hose is introduced into the borehole, and thereby centre the charging hose 3 and thus the nozzle 13 in the borehole, so that the thickness of the tubular wall 20 of the explosive is constant in the circumferential direction at each level in the borehole 11, if the borehole is substantially vertical.

The invention is not limited to what has been described above and shown in the drawings, but can be modified within the scope of the appended claims.

What is claimed is:

1. A method for charging boreholes with explosives, comprising the steps of introducing one end of a charging hose into the borehole to a substantially predetermined distance from the bottom of the borehole, pumping a pumpable explosive through the charging hose at a controlled rate and, essentially simultaneously with the pumping of the explosive, withdrawing the charging hose from the borehole at a controlled rate, thereby causing the explosive to flow out at high pressure in the form of a hollow cone from a nozzle, arranged on said end of the charging hose, such that the outflowing explosive is given increased viscosity and thereby cohesively adheres to the entire cylinder-shaped wall portion of the borehole upon which the explosive impinges in connection with said outflowing, wherein said pumping and withdrawal rates are adjusted such that the explosive is given a tubular shape on the cylinder-shaped wall of the borehole.

2. A method according to claim 1, characterised by keeping the nozzle (13) centred in the borehole (11) during charging.

3. A method according to claim 1, characterised by establishing and maintaining a film of lubricant, specifically water, between the inside of the charging hose (3) and the explosive and by mixing the lubricant with the explosive in the nozzle (13) for achieving a homogeneous, outflowing mixture (18) from the nozzle.

4. A method according to claim 1, characterised by arranging igniting means (16) at the bottom of the borehole (11) and adjusting said pumping and withdrawal rates so that the amount of explosive adjacent to the igniting means (16) exceeds the amount of explosive per length unit in the rest of the borehole (11).

5. A method according to claim 4, characterised by obtaining said exceeding amount of explosive by delaying the withdrawal of the charging hose (3) subsequent to commencing the pumping of the explosive.

6. A method according to claim 1, characterised by the pumpable and cohesive explosive containing a gassing agent and/or by adding a gassing agent adjacent to the nozzle (13).

7. A method according to claim 1, characterised by adjusting said pumping and withdrawal rates so that the explosive is given a tubular shape (20) of variable wall thickness in the longitudinal direction of the borehole (11).

8. A method according to claim 7, characterised by giving the explosive a tubular shape (20) with a wall thickness decreasing towards the opening of the borehole.

9. A method according to claim 2, characterised by establishing and maintaining a film of lubricant, specifically water, between the inside of the charging hose (3) and the explosive and by mixing the lubricant with the explosive in the nozzle (13) for achieving a homogeneous, outflowing mixture (18) from the nozzle.

10. A method according to claim 2, characterised by arranging igniting means (16) at the bottom of the borehole (11) and adjusting said pumping and withdrawal rates so that the amount of explosive adjacent to the igniting means (16) exceeds the amount of explosive per length unit in the rest of the borehole (11).

11. A method according to claim 3, characterised by arranging igniting means (16) at the bottom of the borehole (11) and adjusting said pumping and withdrawal rates so that the amount of explosive adjacent to the igniting means (16) exceeds the amount of explosive per length unit in the rest of the borehole (11).

12. A method according to claim 9, characterised by arranging igniting means (16) at the bottom of the borehole (11) and adjusting said pumping and withdrawal rates so that the amount of explosive adjacent to the igniting means (16) exceeds the amount of explosive per length unit in the rest of the borehole (11).

13. A method according to claim 10, characterised by obtaining said exceeding amount of explosive by delaying the withdrawal of the charging hose (3) subsequent to commencing the pumping of the explosive.

14. A method according to claim 2, characterised by adjusting said pumping and withdrawal rates so that the explosive is given a tubular shape (20) on the cylinder-shaped wall (19) of the borehole (11).

15. A method according to claim 3, characterised by adjusting said pumping and withdrawal rates so that the explosive is given a tubular shape (20) on the cylinder-shaped wall (19) of the borehole (11).

16. A method according to claim 2, characterised by the pumpable and cohesive explosive containing a gassing agent and/or by adding a gassing agent adjacent to the nozzle (13).

17. A method according to claim 3, characterised by the pumpable and cohesive explosive containing a gassing agent and/or by adding a gassing agent adjacent to the nozzle (13).

* * * * *